US010086429B2

(12) United States Patent
Hu et al.

(10) Patent No.: US 10,086,429 B2
(45) Date of Patent: Oct. 2, 2018

(54) CHILLED-ZONE MICROSTRUCTURES FOR CAST PARTS MADE WITH LIGHTWEIGHT METAL ALLOYS

(71) Applicant: GM Global Technology Operations LLC, Detroit, MI (US)

(72) Inventors: Bin Hu, Shanghai (CN); Anil K. Sachdev, Rochester Hills, MI (US); Jon T. Carter, Farmington, MI (US); Jianfeng Wang, Nanjing (CN)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 393 days.

(21) Appl. No.: 14/881,551

(22) Filed: Oct. 13, 2015

(65) Prior Publication Data

US 2016/0114387 A1 Apr. 28, 2016

Related U.S. Application Data

(60) Provisional application No. 62/068,219, filed on Oct. 24, 2014.

(51) Int. Cl.

| | |
|---|---|
| ***B22D 21/04*** | (2006.01) |
| ***B22D 27/04*** | (2006.01) |
| ***B22D 17/00*** | (2006.01) |
| ***C22C 23/02*** | (2006.01) |
| ***C22C 21/02*** | (2006.01) |
| ***C22C 21/10*** | (2006.01) |
| ***B22D 21/00*** | (2006.01) |
| ***B22D 30/00*** | (2006.01) |
| ***C22C 21/06*** | (2006.01) |
| ***C22C 21/08*** | (2006.01) |

(52) U.S. Cl.

CPC ..... *B22D 21/04* (2013.01); *B22D 17/00* (2013.01); *B22D 21/007* (2013.01); *B22D 27/045* (2013.01); *B22D 30/00* (2013.01); *C22C 21/02* (2013.01); *C22C 21/06* (2013.01); *C22C 21/08* (2013.01); *C22C 21/10* (2013.01); *C22C 23/02* (2013.01)

(58) Field of Classification Search

CPC ..... B22D 21/04; B22D 21/007; B22D 17/00; B22D 27/045; B22D 30/00

See application file for complete search history.

(56) References Cited

U.S. PATENT DOCUMENTS

| | | | | |
|---|---|---|---|---|
| 4,474,225 | A | 10/1984 | Yu | |
| 4,847,048 | A * | 7/1989 | Nishi | C22C 21/00 420/532 |
| 5,948,185 | A | 9/1999 | Krajewski et al. | |
| 6,045,636 | A | 4/2000 | Krajewski | |
| 6,675,865 | B1 * | 1/2004 | Yoshida | B22D 17/22 164/113 |
| 6,811,625 | B2 | 11/2004 | Verma | |
| 7,216,927 | B2 | 5/2007 | Luo et al. | |
| 7,967,928 | B2 | 6/2011 | Luo et al. | |
| 8,163,113 | B2 | 4/2012 | Mishra et al. | |
| 8,287,966 | B2 | 10/2012 | Sundarraj et al. | |
| 8,327,910 | B2 | 12/2012 | Walker et al. | |
| 8,708,425 | B2 | 4/2014 | Carlson et al. | |
| 8,852,359 | B2 | 10/2014 | Walker et al. | |
| 8,889,226 | B2 | 11/2014 | Walker et al. | |
| 8,992,696 | B2 | 3/2015 | Walker et al. | |
| 2005/0194072 | A1 | 9/2005 | Luo et al. | |
| 2007/0102131 | A1 * | 5/2007 | Raffle | B22D 17/2218 164/121 |
| 2007/0269337 | A1 | 11/2007 | Luo et al. | |
| 2008/0096039 | A1 | 4/2008 | Sachdev et al. | |
| 2009/0071620 | A1 | 3/2009 | Bharadwaj et al. | |
| 2009/0090479 | A1 * | 4/2009 | Westengen | B22D 17/00 164/113 |
| 2011/0286880 | A1 | 11/2011 | Luo et al. | |
| 2012/0273539 | A1 | 11/2012 | Carter | |
| 2014/0017115 | A1 | 1/2014 | Wang et al. | |
| 2014/0230230 | A1 | 8/2014 | Gao et al. | |
| 2014/0290894 | A1 | 10/2014 | Chen et al. | |

FOREIGN PATENT DOCUMENTS

| | | | |
|---|---|---|---|
| CN | 201217059 | Y | 4/2009 |
| CN | 102717030 | A | 10/2012 |
| CN | 103084545 | A | 5/2013 |
| CN | 105537551 | A | 5/2016 |

(Continued)

OTHER PUBLICATIONS

Liu Lingtao et al.; The Organization and Performance's Influence of High Temperature Homogenization Annealing for 6061 Aluminum Alloy; 2010; 3 pages.

(Continued)

*Primary Examiner* — Kevin P Kerns

*Assistant Examiner* — Steven S Ha

(74) *Attorney, Agent, or Firm* — Harness, Dickey & Pierce, P.L.C.

(57) ABSTRACT

Methods for casting high strength, high ductility lightweight metal components are provided. The casting may be die-casting. A molten lightweight metal alloy is introduced into a cavity of a mold. The molten lightweight metal alloy is solidified and then a solid component is removed from the mold. The solid component is designed to have a thin wall. For example, the solid component has at least one dimension of less than or equal to about 2 mm. In this way, a chill zone microstructure is formed that extends across the at least one dimension of the solid lightweight metal alloy component. The solid component thus may be substantially free of dendritic microstructure formation, enabling more extensive alloy chemistries than previously possible during casting. Such methods may be used to form high strength, high ductility, and lightweight metal alloy vehicle components.

16 Claims, 2 Drawing Sheets

(56) References Cited

FOREIGN PATENT DOCUMENTS

Figure 1:
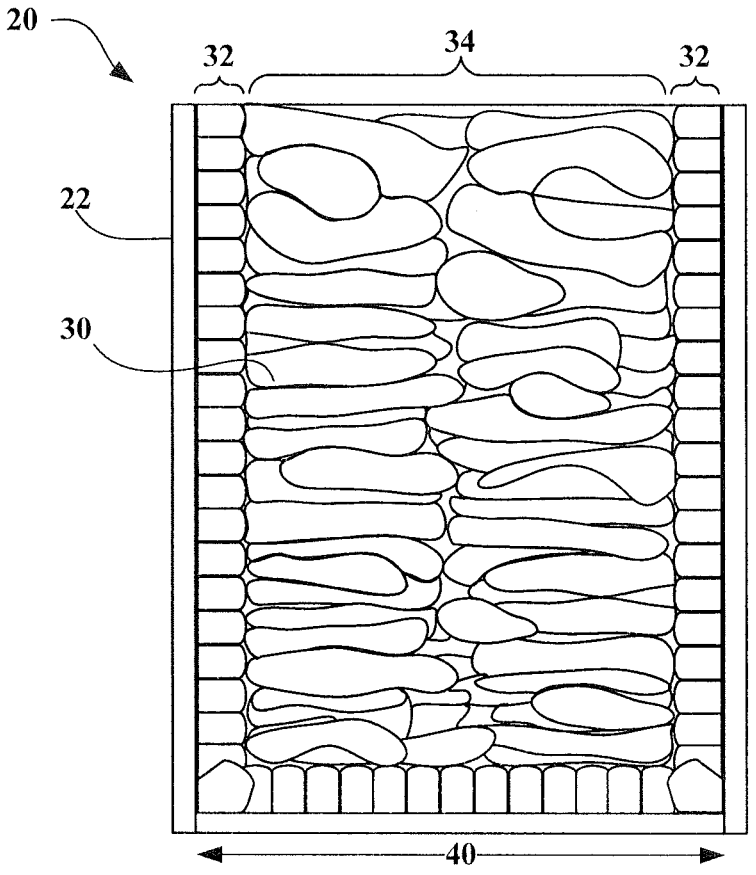

| | | | | |
|---|---|---|---|---|
| DE | 102010055444 | A1 | | 6/2012 |
| DE | 102015117616 | A1 | | 4/2016 |
| GB | 1389784 | A | | 4/1975 |
| JP | S58212849 | A | | 12/1983 |
| JP | 2002339030 | A | * | 11/2002 |

OTHER PUBLICATIONS

First Office Action for Chinese Application No. 201510691630.2 dated May 18, 2017 with English language translation; 17 pages.
Second Office Action for Chinese Application No. 201510691630.2 dated Jan. 29, 2018 with English language translation; 18 pages.

* cited by examiner

Prior Art

Prior Art

CHILLED-ZONE MICROSTRUCTURES FOR CAST PARTS MADE WITH LIGHTWEIGHT METAL ALLOYS

CROSS-REFERENCE TO RELATED APPLICATIONS

This application claims the benefit of U.S. Provisional Application No. 62/068,219 filed on Oct. 24, 2014. The entire disclosure of the application referenced above is incorporated herein by reference.

FIELD

The present disclosure relates to methods of casting lightweight metal alloys, such as aluminum and/or magnesium alloys, where the part design facilitates formation of a chill-zone microstructure, resulting in higher strength and higher ductility cast lightweight metal alloy parts.

BACKGROUND

This section provides background information related to the present disclosure which is not necessarily prior art.

Lightweight metal components have become ever more prevalent when manufacturing vehicles, especially automobiles, where continual improvement in fuel efficiency and performance is desirable. Lightweight metal components for such automotive applications are often made of aluminum, magnesium, and alloys thereof. Such lightweight metals can form components that may be load bearing and need to be strong and stiff, having good strength and ductility (e.g., elongation). High strength and ductility are particularly important for safety requirements and durability in vehicles like automobiles.

An exemplary lightweight metal alloy for structural components in a vehicle is an aluminum-containing alloy. Aluminum-containing alloys can be formed by wrought processes, such as extrusion, forging, stamping, or a casting technique, such as die-casting, sand casting, permanent-mold casting, investment casting, and the like. In such casting, a molten metal may be poured into a casting mold. The molten metal conforms to a shape within the casting mold and thus adopts the shape of the mold cavity as it cools and solidifies. After the metal is solidified and forms a part, the mold is then separated and removed from the part. In a die-casting process, the molten metal material passes through a die defining one or more orifices or apertures, often under pressure. After passing through the in-gate, runners and gating in the die, the molten metal enters a mold cavity where it solidifies to complete the casting process.

All die castings have a very thin chill zone on the outer surfaces of the cast part, which occurs adjacent to the cooler walls of the mold. The chill zone has a different microstructure than other regions of the part. The chill zone is adjacent to an internal dendritic microstructure region that extends from the chill zone towards an interior or center of the cast part. The chill zone is typically only a very small percentage of the total thickness of the part.

When casting alloys, industry standards and limitations during the casting process typically determine which alloy materials and alloying constituents are included. Alloy selection is ultimately tailored to the dendritic microstructure region properties that are needed for the part, while the chill zone microstructure is usually ignored. Sometimes, the chill zone may be partially removed after casting to meet surface roughness, surface appearance, and/or assembly requirements. Strength and other alloy properties could be further improved in view of these conventional casting techniques. Lightweight metal castings, such as aluminum and magnesium castings, need higher strength levels commensurate with those of high strength wrought aluminum and steel stampings. Thus, there is an ongoing need for improved casting processes to form improved lightweight metal components from alloys having suitable castability, strength, and ductility among other characteristics.

SUMMARY

This section provides a general summary of the disclosure and is not a comprehensive disclosure of its full scope or all of its features.

In certain aspects, the present disclosure contemplates a method of casting a lightweight metal component. The method comprises introducing a molten lightweight metal alloy into a cavity of a mold. The molten lightweight metal alloy is solidified and then a solid lightweight metal alloy component is removed from the mold. The solid lightweight metal alloy component is designed to have at least one region with a thin wall. For example, in certain variations, the solid lightweight metal alloy component in at least one region has at least one dimension of less than or equal to about 2 mm, so that a chill zone microstructure is formed that extends across the at least one dimension of the solid lightweight metal alloy component.

In other aspects, a method of casting a lightweight metal component is provided that comprises selecting an alloy comprising a lightweight metal. The alloy is selected to form a chill zone microstructure in the cast solid component, especially in regions of the casting that are designated particularly important to the cast solid component structure. The lightweight metal is selected from the group consisting of: aluminum, magnesium, and combinations thereof. The method may include casting the alloy by introducing molten alloy into a cavity of a mold. Then, the molten alloy is solidified and removed as a solid component from the mold. The solid component is designed to have a thin wall in at least one region. For example, the solid component may have at least one dimension in the at least one region of less than or equal to about 2 mm. In this way, the chill zone microstructure extends across the at least one dimension of the solid component.

In yet other aspects, a method of casting a lightweight metal vehicle component comprises introducing a molten lightweight metal alloy into a cavity of a mold defining a vehicle component shape. The lightweight metal alloy comprises aluminum, magnesium, or combinations of aluminum and magnesium with optional additional elements preselected to provide the appropriate properties. The molten lightweight metal alloy is solidified and then removed as a solid lightweight metal alloy vehicle component from the mold. The solid lightweight metal alloy vehicle component has at least one dimension of less than or equal to about 2 mm so that a chill zone microstructure extends across the at least one dimension of the solid lightweight metal alloy vehicle component.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
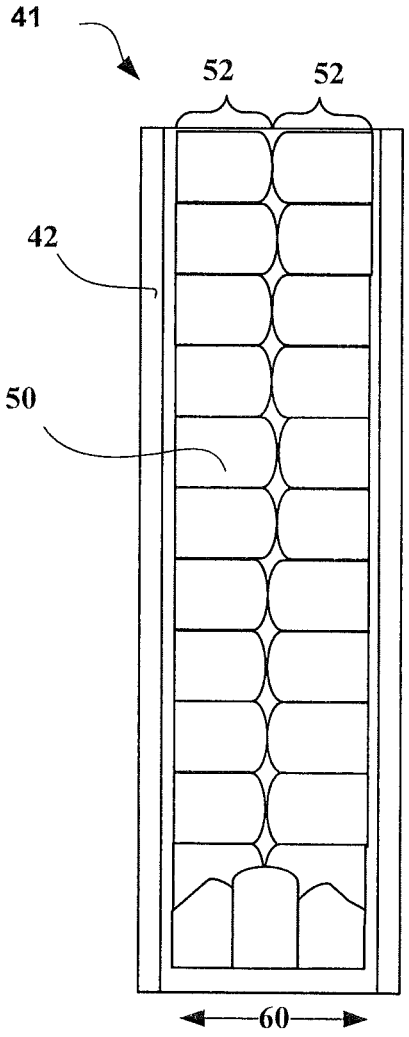

FIG. 1 is an exemplary schematic of a conventional lightweight metal casting system with a solidified lightweight metal part disposed therein; and FIG. 2 is an exemplary schematic of a lightweight metal casting system prepared in accordance with certain aspects of the present disclosure to form a solidified lightweight metal part having only a chill zone microstructure.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

When a component, element, or layer is referred to as being "on," "engaged to," "connected to," or "coupled to" another element or layer, it may be directly on, engaged, connected or coupled to the other component, element, or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various steps, elements, components, regions, layers and/or sections, these steps, elements, components, regions, layers and/or sections should not be limited by these terms, unless otherwise indicated. These terms may be only used to distinguish one step, element, component, region, layer or section from another step, element, component, region, layer or section. Terms such as "first," "second," and other numerical terms when used herein do not imply a sequence or order unless clearly indicated by the context. Thus, a first step, element, component, region, layer or section discussed below could be termed a second step, element, component, region, layer or section without departing from the teachings of the example embodiments.

Spatially or temporally relative terms, such as "before," "after," "inner," "outer," "beneath," "below," "lower," "above," "upper," and the like, may be used herein for ease of description to describe one element or feature's relationship to another element(s) or feature(s) as illustrated in the figures. Spatially or temporally relative terms may be intended to encompass different orientations of the device or system in use or operation in addition to the orientation depicted in the figures.

It should be understood for any recitation of a method, composition, device, or system that "comprises" certain steps, ingredients, or features, that in certain alternative variations, it is also contemplated that such a method, composition, device, or system may also "consist essentially of" the enumerated steps, ingredients, or features, so that any other steps, ingredients, or features that would materially alter the basic and novel characteristics of the invention are excluded therefrom.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. If, for some reason, the imprecision provided by "about" is not otherwise understood in the art with this ordinary meaning, then "about" as used herein may indicate a possible variation of up to 5% of the indicated value or 5% variance from usual methods of measurement.

As used herein, the term "composition" refers broadly to a substance containing at least the preferred metal elements or compounds, but which optionally comprises additional substances or compounds, including additives and impurities. The term "material" also broadly refers to matter containing the preferred compounds or composition.

In addition, disclosure of ranges includes disclosure of all values and further divided ranges within the entire range, including endpoints and sub-ranges given for the ranges.

The present disclosure provides method of casting a lightweight metal component. Lightweight metals may include aluminum, magnesium, combinations, and alloys thereof, as will be described in greater detail below.

Casting generally involves pouring a molten metal alloy into a cavity of a casting mold. The molten metal alloy is introduced into a mold, where the metal alloy solidifies after cooling, to form a solidified cast part or component. Lightweight metal alloys according to certain aspects of the present disclosure are suitable for casting, including die-casting, sand casting, permanent-mold casting, and investment casting, by way of non-limiting example. In various aspects, the lightweight metal alloy is particularly suitable for a die-casting process, where the molten alloy material passes through a die defining one or more orifices or apertures as it enters a mold cavity during the casting process. While casting techniques are disclosed herein, it is understood that in select instances, the lightweight metal alloy can also be employed in wrought processes. In certain variations, the cast solid parts form lightweight metal structural components, which have one or more surfaces that are further machined after casting and solidification.

While exemplary components are illustrated and described throughout the specification, it is understood that the inventive concepts in the present disclosure may also be applied to any structural component capable of being formed of a lightweight metal, including those used in vehicles, like automotive applications including, but not limited to, pillars, such as hinge pillars, panels, including structural panels, door panels, and door components, interior floors, floor pans, roofs, exterior surfaces, underbody shields, wheels, storage areas, including glove boxes, console boxes, trunks, trunk floors, truck beds, lamp pockets and other components, shock tower cap, control arms and other suspension or drive train components, and the like. Specifically, the present disclosure is particularly suitable for any piece of hardware subject to loads or impact (e.g., load bearing).

In various aspects, lightweight metal alloys are particularly suitable for die-casting processes, where the molten alloy material passes through a die defining one or more in-gate, runners and gating as it enters a mold cavity during the casting process. While die casting is primarily described herein, it is understood that in select instances, the lightweight metal alloys are also useful in other casting processes that employ molds that are known in the art. FIG. 1 shows an exemplary simplified conventional casting system 20. A casting mold 22 defines a cavity filled with a solidified lightweight metal alloy 30. The solidified lightweight metal alloy part 30 defines two distinct microstructural regions. All die castings have a very thin chill zone, shown as chill zone microstructure 32 on the surface of the cast part (e.g., solidified lightweight metal alloy part 30). The chill zone microstructure 32 is formed adjacent to the walls of the mold 22, where the molten alloy is subjected to relative chilling due to the heat sink created by the adjacent mold 22. The nucleation phase of solidification typically originates in the chill zone 32 region. In a typical die casting, a chill zone microstructure 32 is less than or equal to about 1 mm thick in the solidified lightweight metal alloy part 30 along each wall of the mold 22. The grain sizes in the chill zone microstructure are uniform and relatively fine.

As shown in FIG. 1, during the solidification process, as more heat is removed, long thin columns or dendrites are formed that define a eutectic dendritic microstructure 34. The eutectic dendritic microstructure 34 is formed adjacent to the chill zone microstructure 32 and extends towards a central region of the solidified lightweight metal alloy part 30. It should be noted that additional microstructures might likewise be formed beyond the chill zone microstructure 32 and eutectic dendritic microstructure 34, depending on an overall thickness of the part and solidification conditions. The chill zone is generally a small percentage of the total thickness. A thickness designated 40 of the conventional solidified lightweight metal alloy part 30 is thus far greater than 2 mm (the maximum cumulative width or thickness of chill zone dimensions 32 at 1 mm).

In certain aspects, the present disclosure provides methods of casting a lightweight metal component that includes introducing a molten lightweight metal alloy into a cavity of a mold. Then, the molten lightweight metal alloy is solidified and removed from the mold. The solidified lightweight metal alloy forms a solid lightweight metal alloy component having at least one dimension that is considered to be thin, so that thin wall part castings are formed. The at least one dimension may extend across the entire solid lightweight metal alloy component or only in certain regions of particular importance to the structure of the component.

With reference to FIG. 2, an exemplary simplified casting system 41 in accordance with certain aspects of the present disclosure is shown. A casting mold 42 defines a cavity filled with a solidified lightweight metal alloy 50. The solidified lightweight metal alloy part 50 defines a single chill zone microstructure 52. The chill zone microstructure 52 is formed adjacent to the walls of the mold 42 and extends to a center of the solidified lightweight metal alloy 50. Thus, in accordance with various aspects of the present disclosure, an entire cross-section through the thickness or width of the part has the chill zone microstructure 52 in at least one region of the part. As such, minimal or no eutectic dendritic or other non-chill zone microstructures are formed in the solidified lightweight metal alloy 50.

A thickness or width designated 60 of at least one region of the solidified lightweight metal alloy part 50 according to certain aspects of the present disclosure is considered to be thin (e.g., to form a thin wall). In certain aspects, a dimension may be considered to be thin if it is less than or equal to about 2 mm, optionally less than or equal to about 1.75 mm, optionally less than or equal to about 1.5 mm, optionally less than or equal to about 1.25 mm, optionally less than or equal to about 1 mm, optionally less than or equal to about 0.75 mm, and in certain variations, optionally less than or equal to about 0.5 mm. It should be noted that the part may have other dimensions well in excess of 2 mm (such as height and/or length), so long as the chill zone microstructure is formed and extends across the solid lightweight metal alloy component (e.g., across the width of the part or component). In this manner, the method provides a chill zone microstructure that extends throughout the entirety of the thin dimension of the solid lightweight metal alloy component.

While in certain desirable variations, a cast solid lightweight metal alloy component may have at least one dimension considered to be a thin wall extending throughout the entire part, in other alternative aspects, select regions of the cast solid lightweight metal alloy component may include the at least one dimension considered to be a thin wall with a chill zone microstructure, while other regions of the cast solid component may be slightly thicker (e.g., regions that are of less importance to the structural integrity of the solid part or where castings have a complex shape, some select regions may not be fully in a chill zone).

In certain aspects, where the thin dimension of the cast part has a chill zone microstructure in accordance with the present teachings, the eutectic dendrite microstructure formation is minimized or absent, such that the chill zone microstructure region has less than or equal to about 20% by volume of the cross-section spanning the thin dimension comprising any eutectic dendrites or dendritic microstructure, optionally less than or equal to about 15% by volume, optionally less than or equal to about 10% by volume, and optionally less than or equal to about 5% by volume of any dendritic microstructure. In accordance with certain aspects of the present disclosure, solidified lightweight metal alloy 50 is substantially free of microstructures other than the chill zone microstructures, including dendritic microstructure regions. The term "substantially free" as referred to herein means that the dendritic microstructure or other microstructures are absent to the extent that that physical properties and limitations attendant with their presence are avoided. In certain embodiments, a solidified lightweight metal alloy part or component that is "substantially free" of dendritic or other non-chill zone microstructures comprises less than or equal to about 5% by volume of the dendritic of other non-chill zone microstructures, more preferably less than or equal to about 4% by volume, optionally less than or equal to about 3% by volume, optionally less than or equal to about 2% by volume, optionally less than or equal to about 1% by volume, optionally less than or equal to about 0.5% by volume and in certain embodiments comprises 0% by volume of the dendritic or other non-chill zone microstructures.

Typically, when selecting lightweight metal alloys for casting, the dendritic microstructure properties govern choice of the specific alloy. Such properties include tensile strength, ductility (e.g., elongation), castability, fluidity, solidification, weldability, by way of example. In accordance with the principles of the present teachings, by ensuring the entire thickness of the part has only a chill zone microstructure, the constraints on the alloys that would otherwise be required by the presence of the dendritic microstructure (or non-chill zone microstructures) are desirably eliminated. In casting a part with controlled thicknesses, the cross-section has only the chill zone microstructure, which can enable alloy chemistries producing higher attendant strengths, when the eutectic dendritic structure is minimized. In accordance with this principle, richer lightweight metal alloy chemistries are possible that provide higher strength and higher ductility, among other properties. Further, a chill zone microstructure extending across the entire thickness of the part provides a substantially uniform microstructure in the cross-section from casting that provides higher toughness and fatigue strength. By "substantially uniform," it is meant that the microstructure has substantially the same microstructure, composition, grain boundaries, and grain sizes throughout the region or solid phase. Additionally, heat-treatment may be accelerated due to uniform solute distribution in a chill zone microstructure.

Thus, in certain aspects, the present disclosure contemplates a method of casting a lightweight metal component. The method comprises selecting an alloy comprising a lightweight metal to form a chill zone microstructure in a solid component. The lightweight metal is selected from the group consisting of: aluminum, magnesium, and combinations thereof, optionally further including minor additional alloying elements, as needed for strength and toughness. The method further includes casting the alloy by introducing molten alloy into a cavity of a mold. Then the molten alloy is solidified and removed from the mold to form the solid component having at least one dimension of less than or equal to about 2 mm. The solid component thus has a chill zone microstructure that extends throughout the at least one dimension of the solid component. The solid lightweight metal alloy component formed by such a process may be substantially free of any dendritic microstructure. The method of casting may be a die-casting process, where the introducing of the molten material includes passing the molten metal through an in-gate, a runner and gating before it enters the cavity of the mold.

In certain variations, the mold itself may be chilled or have a heat exchange system for further cooling the metal in the mold cavity (for example, a water-cooled mold). Based on the amount of heat flux drawn out of the molten metal, in such embodiment, the cast part wall thickness may be somewhat greater than 2 mm.

In certain aspects, the lightweight metal alloy comprises aluminum. As used herein, an aluminum alloy generally refers to an alloy comprising greater than or equal to about 80 weight % aluminum combined with other alloying ingredients and impurities. In other aspects, the lightweight metal alloy comprises magnesium. A magnesium alloy generally refers to an alloy comprising greater than or equal to about 80 weight % magnesium combined with other alloying constituents and impurities. In yet other aspects, the lightweight metal alloy comprises aluminum and magnesium. An aluminum and magnesium alloy cumulatively comprises aluminum and magnesium at greater than or equal to about 90 weight % with a balance of other alloying ingredients and impurities.

In certain variations, the lightweight metal alloy is an aluminum alloy that previously has not been suitable for use in casting. However, in accordance with the present disclosure, the design of the cast part to have only a chill zone microstructure enables the use of such an alloy that was otherwise not suitable. Thus, non-conventional, richer chemistry alloys may be used in casting by adjusting a total cast part thickness to be only a chilled-zone microstructure. By way of non-limiting example, alloys may have up to 15% by weight magnesium in an aluminum alloy. For example, an entirely chill-zone microstructure contains more magnesium solute in alpha aluminum grains and has less eutectic phase in grain boundaries. In this way, higher strength aluminum and magnesium alloys are contemplated by providing the ability to incorporate additional alloying ingredients, resulting in a variety of benefits, including reduction of mass of structural body castings. In certain aspects, a lightweight metal alloy in accordance with the present disclosure may also have improved corrosion resistance. Such an alloy is selected to be an alloy comprising aluminum with high magnesium contents, which would not be otherwise possible when designing a cast part where a eutectic dendritic microstructure forms.

Thus, in certain aspects, the present disclosure contemplates aluminum alloy compositions suitable for die casting having a composition comprising magnesium at greater than or equal to about 8 weight % to less than or equal to about 15 weight % of the lightweight metal alloy. Silicon is present at greater than or equal to about 0.5 weight % to less than or equal to about 2.5 weight % of the lightweight metal alloy. Manganese is present in the aluminum alloy at greater than or equal to about 0.3 weight % to less than or equal to about 0.5 weight % of the lightweight metal alloy. One or more impurities in the aluminum alloy are cumulatively present at less than or equal to about 0.5 weight % of the alloy, optionally less than or equal to about 0.1 weight % in certain aspects, while a balance is aluminum.

In another variation, a lightweight metal alloy comprises aluminum, magnesium, and silicon. For example, magnesium may be present at greater than or equal to about 0.5 weight % to less than or equal to about 1.5 weight % of the lightweight metal alloy. Silicon is present at greater than or equal to about 8 weight % to less than or equal to about 10 weight % of the lightweight metal alloy. Manganese is present at greater than or equal to about 0.3 weight % to less than or equal to about 0.5 weight % of the lightweight metal alloy. The lightweight metal alloy also has one or more impurities cumulatively present at less than or equal to about 0.5 weight % of the lightweight metal alloy with a balance being aluminum.

In yet another variation, the lightweight metal alloy comprises aluminum and zinc. Zinc may be present at greater than or equal to about 5 weight % to less than or equal to about 8 weight % of the lightweight metal alloy. The lightweight metal alloy may have silicon at greater than or equal to about 0.5 weight % to less than or equal to about 1.5 weight % of the lightweight metal alloy. Manganese may be present at greater than or equal to about 0.3 weight % to less than or equal to about 0.5 weight % of the lightweight metal alloy. The lightweight metal alloy may also comprise one or more impurities cumulatively present at less than or equal to about 0.5 weight %, with a balance of aluminum.

By way of comparison, alloy compositions of both conventional lightweight metal casting alloys and new lightweight metal casting alloys in accordance with certain aspects of the present disclosure are shown in Table 1 below. A traditional aluminum-magnesium alloy (Conventional Al—Mg Alloy A commercially available as MAGSIMAL™-59) has only 4.5-5.0 weight % magnesium, while New Al—Mg Alloy 1 according to certain variations of the present disclosure has a significantly increased magnesium content of 8-15 weight %, enabled by the cast component design having at least one thin wall to ensure chill zone microstructure formation through the wall. Further, silicon content and manganese content in the New Al—Mg Alloy 1 can be reduced as compared to the Conventional Al—Mg Alloy A. Aluminum alloys, like New Al—Mg Alloy 1 have higher strength with improved ductility, as compared to comparable conventional alloys like Conventional Al—Mg Alloy A.

TABLE 1

| | Mg (wt. %) | Si (wt. %) | Mn (wt. %) | Zn (wt. %) | Impurities (wt. %) | Balance |
|---|---|---|---|---|---|---|
| Conventional Al—Mg Alloy A (MAGSIMAL ™-59) | 4.5-5.0 | 2.0-2.5 | 0.5~0.8 | — | ≤0.5 | Al |
| New Al—Mg Alloy 1 | 8-15 | 0.5-2.5 | 0.3~0.5 | — | ≤0.5 | Al |
| Conventional Al—Si—Mg Alloy B (SILAFONT ™-36) | 0.25-0.8 | 8-10 | 0.5~0.8 | | ≤0.5 | Al |
| New Al—Si—Mg Alloy 2 | 0.5-1.5 | 8-10 | 0.3~0.5 | — | ≤0.5 | Al |
| New Al Alloy 3 (Al—Zn system) | — | 0.5-1.5 | 0.3~0.5 | 5-8 | ≤0.5 | Al |

Likewise, a conventional aluminum and magnesium alloy (Conventional Al—Si—Mg Alloy B) has only 0.25-0.8 weight % magnesium, while New Al—Si—Mg Alloy 2 according to certain aspects of the present disclosure has a significantly increased magnesium content (0.5-1.5 weight %), enabled by the cast component design having at least one thin wall to ensure chill zone microstructure formation through the wall. Further, manganese content in the New Al—Si—Mg Alloy 2 can be reduced below the 0.5 minimum amount in Conventional Al—Si—Mg Alloy B. In New Al—Si—Mg Alloy 2, more magnesium is dissolved in Al—Si to provide improved yield strength, without sacrificing ductility. Further, in such a system, solution heat-treatment process times can be reduced, or in certain aspects, solution heat-treatment processing can be eliminated.

The composition of another new aluminum alloy contemplated for casting in accordance with certain aspects of the present disclosure, Al Alloy 3 comprises an aluminum and zinc system. Zinc is present at 5-8 weight % in Al Alloy 3. Conventional Al—Si—Mg Alloy B has no zinc. New Al Alloy 3 does not have any magnesium, but has the same amount of manganese as New Al—Si—Mg Alloy 2 discussed above. The silicon content in New Al Alloy 3 is 0.5-1.5 weight %. In an alloy like New Al—Si—Mg Alloy 2, zinc content can be increased to impart higher strength and ductility to the alloy. Further, solution heat-treatment time may be reduced.

In one variation, an aluminum alloy comprises magnesium at greater than or equal to about 8 weight % to less than or equal to about 15 weight % of the lightweight metal alloy. Silicon is present at greater than or equal to about 0.5 weight % to less than or equal to about 2.5 weight % of the lightweight metal alloy. Manganese is present at greater than or equal to about 0.3 weight % to less than or equal to about 0.5 weight % of the lightweight metal alloy. One or more impurities may be cumulatively present at less than or equal to about 0.5 weight % in the lightweight metal alloy and a balance of the alloy being aluminum.

Conventional and new magnesium alloy compositions in accordance with certain variations of the present disclosure are shown in Table 2 below. A traditional magnesium alloy (Conventional Mg—Al Alloy C commercially available as AZ91D) has about 8.5-9.0 weight % aluminum, while New Mg—Al Alloy 4 according to certain variations of the present disclosure has a significantly increased aluminum content of 12-13 weight %, enabled by the cast component design having at least one thin wall to ensure chill zone microstructure formation through the wall. Zinc content may be increased to 0.7-1.0 weight % in the New Mg—Al Alloy 4. Further, manganese content in the New Al—Mg Alloy 1 can be reduced as compared to the Conventional Al—Mg Alloy A (to 0.2-0.3 weight %).

TABLE 2

| | Al (wt. %) | Mn (wt. %) | Zn (wt. %) | Impurities (wt. %) | Balance |
|---|---|---|---|---|---|
| Conventional Mg—Al Alloy C (AZ91D) | 8.5-9.0 | 0.3-0.5 | 0.5~0.8 | ≤0.5 | Mg |
| New Mg Alloy 4 | 12-13 | 0.2-0.3 | 0.7~1.0 | ≤0.5 | Mg |

Thus, in certain variations, a lightweight metal alloy is a magnesium alloy further including aluminum, manganese, and zinc. Such a lightweight metal alloy is particularly suitable for die casting. For example, a magnesium alloy may comprise aluminum present at greater than or equal to about 12 weight % to less than or equal to about 13 weight % of the lightweight metal alloy. Manganese is present at greater than or equal to about 0.2 weight % to less than or equal to about 0.3 weight % of the lightweight metal alloy. Zinc is present at greater than or equal to about 0.7 weight % to less than or equal to about 1.0 weight % of the lightweight metal alloy. The lightweight metal alloy also has one or more impurities cumulatively present at less than or equal to about 0.5 weight % of the lightweight metal alloy with a balance being magnesium.

As noted above, the selection of alloys in accordance with the principles of the present disclosure can form solid lightweight metal components or parts having superior strength and ductility (e.g., elongation). In certain aspects, a cast solid lightweight metal component formed in accordance with certain aspects of the present disclosure has a percentage of elongation of greater than or equal about 15%. In certain aspects, a percentage of elongation may optionally be greater than or equal to about 15% up to about 25%. In other aspects, a high strength cast solid lightweight metal component has a tensile strength of greater than or equal to 300 MPa. In certain variations, a high strength cast solid lightweight metal component has a tensile strength of greater than or equal to 300 MPa to less than or equal to about 700 MPa.

In various aspects, the present methods of casting create solid lightweight metal components or parts having a substantially uniform microstructure (e.g., eliminating segregation and bands). Further, more solute and alloying ingredients can be distributed in the metal matrix, with less eutectic phase formation. In traditional high pressure die-casting processes, concentration of alloying ingredients with the metal is not necessarily uniform, as inhomogeneity may occur. However, in certain aspects, the solid lightweight metal components or parts having only a chill zone microstructure formed in accordance with the present teachings have a homogenous and substantially uniform composition, where concentration of ingredients is homogenously distributed throughout. Such a microstructure results in higher ductility and higher strength in the cast part.

Further, any heat-treatment time may be reduced. For example, solution heat-treatment processing times can be reduced, or in certain aspects, even eliminated altogether. By way of non-limiting example, in one variation, a solution time of a conventional super-vacuum high pressure die cast (HPDC) body components (e.g., an Al hinge pillar) is 460° C. for 2 hours. A cast solid lightweight metal component prepared in accordance with certain aspects of the present teachings having a chill zone microstructure may only need a solution time reduced to less than or equal to about 20 minutes, or the solution treatment may be eliminated altogether, depending on the requirements of a cast part for a predetermined application.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of casting a lightweight metal component comprising:

introducing a molten lightweight metal alloy into a cavity of a mold, wherein the lightweight metal alloy comprises:

zinc at greater than or equal to about 5 weight % to less than or equal to about 8 weight % of the lightweight metal alloy;

silicon at greater than or equal to about 0.5 weight % to less than or equal to about 1.5 weight % of the lightweight metal alloy;

manganese at greater than or equal to about 0.3 weight % to less than or equal to about 0.5 weight % of the lightweight metal alloy;

one or more impurities at cumulatively less than or equal to about 0.5 weight % of the lightweight metal alloy; and a balance of aluminum;

solidifying the molten lightweight metal alloy; and removing a solid lightweight metal alloy component from the mold, wherein the solid lightweight metal alloy component has a region with at least one dimension of less than or equal to about 2 mm so that a chill zone microstructure extends across the at least one dimension of the solid lightweight metal alloy component.

2. The method of claim 1, wherein the chill zone microstructure has less than or equal to about 20 volume % of a dendritic microstructure.

3. The method of claim 1, wherein the solid lightweight metal alloy component is substantially free of any dendritic microstructure.

4. The method of claim 1, wherein the method of casting is a die-casting process, wherein the introducing of the molten lightweight metal alloy includes passing the molten lightweight metal alloy through an in-gate, a runner and a gating system before entering the cavity of the mold.

5. The method of claim 1, wherein the solid lightweight metal alloy component has a percentage of elongation of greater than or equal to about 15%.

6. The method of claim 1, wherein the solid lightweight metal alloy component has a tensile strength of greater than or equal to about 350 MPa.

7. A method of casting a lightweight metal component comprising:

selecting an alloy comprising a lightweight metal to form a chill zone microstructure in at least one region of a solid component, wherein the lightweight metal comprises:

zinc at greater than or equal to about 5 weight % to less than or equal to about 8 weight % of the alloy;

silicon at greater than or equal to about 0.5 weight % to less than or equal to about 1.5 weight % of the alloy;

manganese at greater than or equal to about 0.3 weight % to less than or equal to about 0.5 weight % of the alloy;

one or more impurities at cumulatively less than or equal to about 0.5 weight % of the alloy; and a balance of aluminum;

casting the alloy by introducing molten alloy into a cavity of a mold; and solidifying the molten alloy and removing the solid component from the mold, wherein the at least one region of the solid component has at least one dimension of less than or equal to about 2 mm and the chill zone microstructure extends across the at least one dimension of the solid component.

8. The method of claim 7, wherein the chill zone microstructure has less than or equal to about 20 volume % of a dendritic microstructure.

9. The method of claim 7, wherein the solid component is substantially free of any dendritic microstructure.

10. The method of claim 7, wherein the solid component has a percentage of elongation of greater than or equal to about 15%.

11. The method of claim 7, wherein the solid component has a tensile strength of greater than or equal to about 350 MPa.

12. A method of casting a lightweight metal vehicle component comprising:

introducing a molten lightweight metal alloy into a cavity of a mold defining a vehicle component shape, wherein the lightweight metal alloy comprises:

zinc at greater than or equal to about 5 weight % to less than or equal to about 8 weight % of the molten lightweight metal alloy;

silicon at greater than or equal to about 0.5 weight % to less than or equal to about 1.5 weight % of the molten lightweight metal alloy;

manganese at greater than or equal to about 0.3 weight % to less than or equal to about 0.5 weight % of the molten lightweight metal alloy;

one or more impurities at cumulatively less than or equal to about 0.5 weight % of the molten lightweight metal alloy; and a balance of aluminum;

solidifying the molten lightweight metal alloy; and removing a solid lightweight metal alloy vehicle component from the mold, wherein the solid lightweight metal alloy vehicle component has at least one region with at least one dimension of less than or equal to about 2 mm, so that a chill zone microstructure extends across the at least one dimension of the solid lightweight metal alloy vehicle component.

13. The method of claim 12, wherein the chill zone microstructure has less than or equal to about 20 volume % of a dendritic microstructure.

14. The method of claim 12, wherein the solid lightweight metal alloy vehicle component is substantially free of any dendritic microstructure.

15. The method of claim 12, wherein the solid lightweight metal alloy vehicle component has a percentage of elongation of greater than or equal to about 15%.

16. The method of claim 7, wherein the solid lightweight metal alloy vehicle component has a tensile strength of greater than or equal to about 350 MPa.

* * * * *